US006183572B1

(12) United States Patent
Panchanathan et al.

(10) Patent No.: US 6,183,572 B1
(45) **Date of Patent: *Feb. 6, 2001**

(54) ISOTROPIC RARE EARTH MATERIAL OF HIGH INTRINSIC INDUCTION

(75) Inventors: Viswanathan Panchanathan, Anderson; William Ray Green, Pendleton; Kevin Allen Young, Fairmount, all of IN (US)

(73) Assignee: Magnequench International, Inc., Anderson, IN (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/000,789

(22) Filed: Dec. 30, 1997

(51) Int. Cl.[7] ..... H01F 1/057

(52) U.S. Cl. ..... 148/302; 148/101

(58) Field of Search ..... 148/302, 101, 148/102, 103

(56) References Cited

U.S. PATENT DOCUMENTS

| | | | | |
|---|---|---|---|---|
| 5,178,692 | * | 1/1993 | Panchanathan | 148/101 |
| 5,230,751 | * | 7/1993 | Endoh et al. | 148/302 |
| 5,449,417 | * | 9/1995 | Shimizu et al. | 148/302 |
| 5,634,987 | * | 6/1997 | Zhang et al. | 148/302 |
| 5,725,792 | * | 3/1998 | Panchanathan | 148/302 |

* cited by examiner

*Primary Examiner*—John Sheehan
(74) *Attorney, Agent, or Firm*—Pennie & Edmonds LLP

(57) ABSTRACT

Isotropic magnetic alloy powder having an intrinsic magnetic induction of at least two third of its magnetic remanence and method for making same are provided. The powder is made from an alloy having a composition comprising, by weight percentage, approximately 15 to 35 percent of one or more rare earth metals, approximately 0.5 to 4.5 percent of boron, and approximately 0 to 20 percent of cobalt, balanced with iron. The alloy powder is made by a process wherein an amount of the alloy is melt and spun in an inert environment, preferably at a distance between an orifice and a wheel being less than one and one half inches, into ribbons, followed by crushing the ribbons into powder and annealing the powder.

13 Claims, 2 Drawing Sheets

ISOTROPIC RARE EARTH MATERIAL OF HIGH INTRINSIC INDUCTION

FIELD OF THE INVENTION

This invention relates generally to isotropic rare earth-boron-iron magnetic material, and more particularly to isotropic rare earth-iron-boron magnetic material having a high intrinsic induction, and a process for making same.

BACKGROUND OF THE INVENTION

Isotropic magnetic material having a high intrinsic induction is desired. A higher intrinsic induction means a higher magnetic flux, which allows thinner and lighter magnets to be made from such material. It is preferable to use thinner and lighter magnets in many applications.

The presently available isotropic rare earth-boron-iron iron magnetic material, however, has a relatively low intrinsic induction. For example, the commercially available isotropic rare earth-boron-iron magnetic powder MQP-B manufactured by Magnequench International Inc. has an intrinsic coercivity of 9 kOe. At two third of this intrinsic coercivity value (i.e., about 6 kOe), the intrinsic magnetic induction value for the powder is approximately 4.5 kG. The nominal magnetic remanence value for this powder is about 8.2 kG. Thus, the intrinsic magnetic induction of 4.5 kG for this powder is only about 55 percent of its magnetic remanence value. It is desired that the intrinsic magnetic induction value of a magnetic material be a higher percentage of its magnetic remanence value.

It is therefore an object of the present invention to provide an isotropic rare earth-boron-iron material having a higher intrinsic induction value; and It is another object to provide a process for making such material.

SUMMARY OF THE INVENTION

The present invention provides an isotropic rare earth-boron-iron magnetic material having an intrinsic magnetic induction, when measured at two third of its intrinsic coercivity and without taking into consideration of demagnetization correction factor, of at least two-thirds of its magnetic remanence. Preferably, the magnetic material of the present invention is made from an alloy having a composition comprising, by weight percentage, approximately 15 to 35 percent of one or more rare earth metals, approximately 0.5 to 4.5 percent of boron, and approximately 0 to 20 percent of cobalt, balanced with iron.

In a preferred embodiment, the magnetic material of the present invention is made by first forming ribbons from the alloy by a melt spinning process under an inert environment. Preferably, in this process, in order to obtain desired magnetic properties, the distance between an orifice and a wheel is maintained at less than one and one half inches. The ribbons obtained from this melt spinning process are then crushed into powder and annealed at a temperature above 400° C. and preferably, at least 600° C.

BRIEF DESCRIPTION OF THE DRAWINGS

These and other objects, features and advantages of the invention will be more apparent from the following detailed description in conjunction with the appended drawings in which.

DETAILED DESCRIPTION OF THE INVENTION

The present invention provides isotropic rare earth-boron-iron magnetic material having an intrinsic induction of at least two-thirds of its magnetic remanence value, when measured at two-thirds of its intrinsic coercivity, and method for making same. Preferably, the intrinsic induction value is at least 70 percent and more preferably, at least 75 percent, of its magnetic remanence, when measured at two-thirds of its intrinsic coercivity.

In accordance with the present invention, isotropic magnetic material is made from an alloy having a composition comprising, by weight percentage, approximately 15 to 35 percent of one or more rare earth metals, approximately 0.5 to 4.5 percent of boron, and approximately 0 to 20 percent of cobalt, balanced with iron. The isotropic magnetic material of the present invention is made by a melt spinning process. In accordance with the present invention, in the melt spinning process, the distance between an orifice and a wheel is preferably less than one and one-half inches to form ribbons. The ribbons are then crushed to form powder which is then annealed at a temperature above 400° C. Preferably, the temperature of the annealing is at least 600° C. The isotropic magnetic material obtained in accordance with the present invention exhibits an intrinsic induction of at least two-thirds of its magnetic remanence, when measured at two-thirds of its intrinsic coercivity and without taking into consideration of demagnetization correction factor.

It should be recognized that the isotropic rare earth-boron-iron magnetic material of the present invention may be in many different forms including, but not limited to, ribbons, powder, or magnets.

Figure 1:
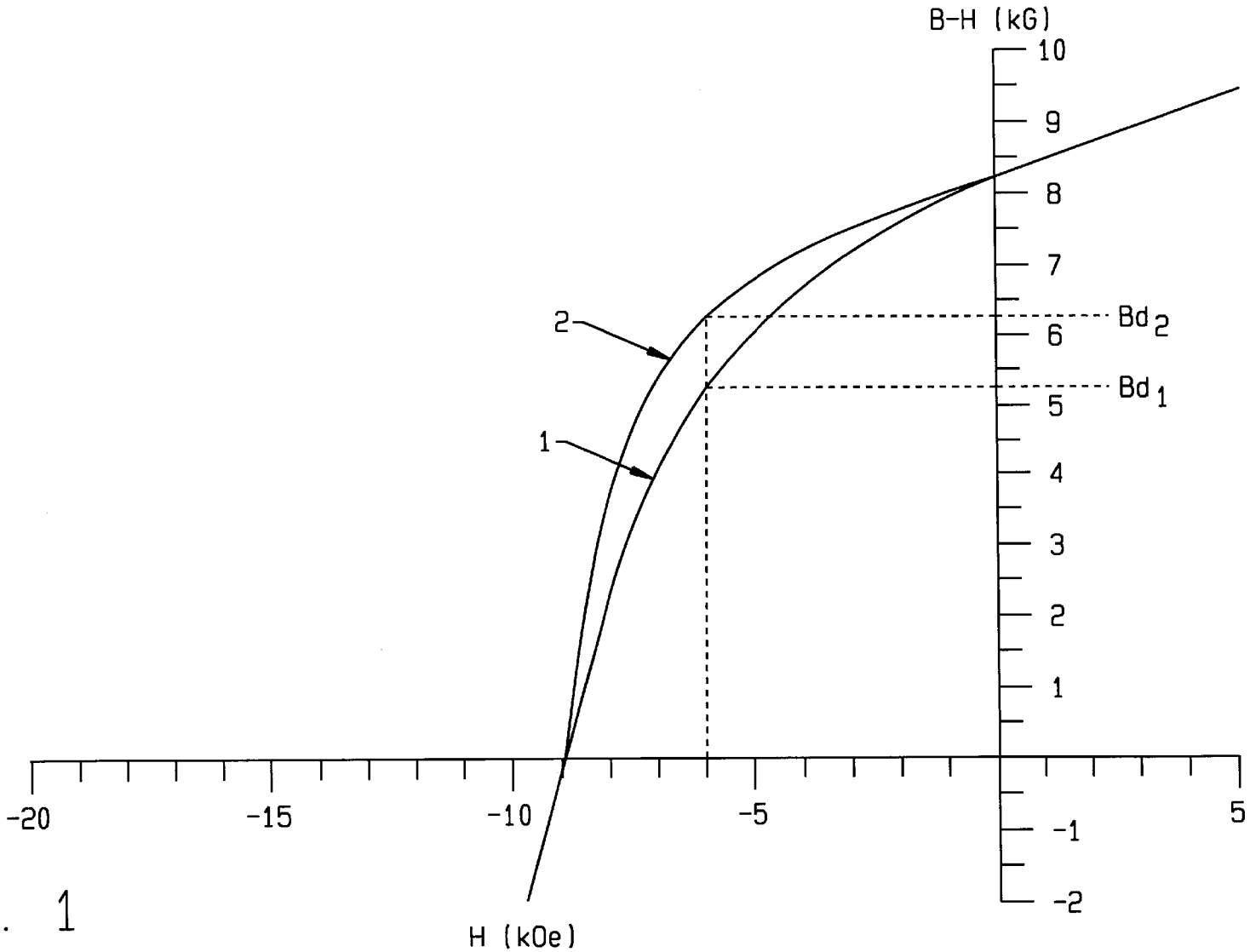
FIG. 1 illustrates the demagnetization curves, respectively, of a conventional isotropic rare earth-boron-iron iron magnetic material and an isotropic rare earth-boron-iron magnetic material of the present invention which exhibits a higher intrinsic magnetic induction.

Illustratively, FIG. 1 shows the demagnetization curves of conventional isotropic rare earth-boron-iron magnetic material (Curve 1) and the magnetic material of the present invention having a higher intrinsic induction (Curve 2), respectively. Illustratively, the conventional isotropic magnetic material, as its demagnetization curve is shown as Curve 1, has an intrinsic coercivity of about 9 kOe and a magnetic remanence, Br, of about 8.25 kG. Thus, when measured at two-thirds of its intrinsic coercivity, such conventional magnetic material has an intrinsic induction, Bdl, of about 5.25 kG, which is less than two-thirds (about 5.5 kG) of its magnetic remanence. In comparison, the isotropic magnetic powder of the present invention, with its magnetization curve illustrated as Curve 2, has the same intrinsic coercivity (about 9 koe) and remanence (about 8.25). However, the powder of the present invention exhibits a higher intrinsic induction—its intrinsic induction, Bd2. when measured at two-thirds of its intrinsic coercivity, is about 6.25 kG, more than two-thirds (about 5.5 kG) of its magnetic remanence.

In the alloy used to form the isotropic magnetic material of the present invention, other elements may also be present in minor amounts of up to about two weight percent, either alone or in combination. These elements include, but not limited to, tungsten, chromium, nickel, aluminum, copper, magnesium, manganese, gallium, niobium, vanadium, molybdenum, titanium, tantalum, zirconium, carbon, tin and calcium. Silicon is also typically present in small amounts, as are oxygen and nitrogen.

The present invention is further described by the following examples, which are intended to be illustrative of the present invention and should not be construed, in any way, to be a limitation thereof.

EXAMPLES

Example 1

Figure 2:
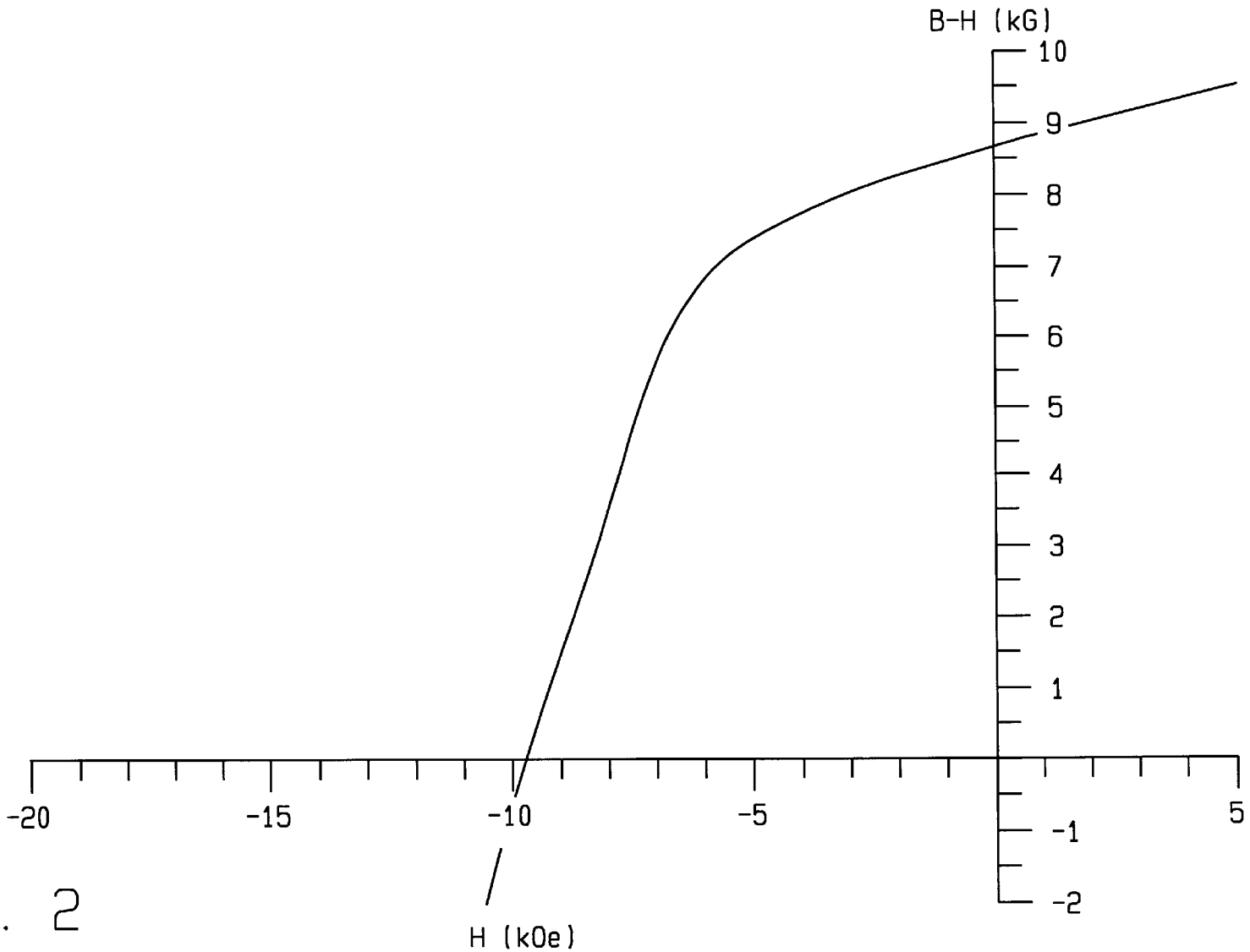
FIG. 2 is the measured demagnetization curve of the magnetic material of the present invention as described in Example 1 below.

An alloy of a nominal composition having a concentration of, in weight percentage, 28.2 percent of rare earth, 0.92 percent of boron, 5.0 percent of cobalt, balanced with iron, was melt spun in an argon atmosphere at 32 meters per second. The ribbons produced from this melt-spun process were then crushed into powder of less than 40 mesh size. It was then annealed at 600° C for 4 minutes in an argon environment. The demagnetization curve of the powder as measured is shown in FIG. 2. The magnetic properties of the powder are listed as follows:

| | |
|---|---|
| Br (magnetic remanence) | 8.55 kG |
| Hci (intrinsic coercivity) | 9.75 kOe |
| BHmax (energy product) | 14.2 MGOe |
| Bd (intrinsic induction measured at ⅔ of Hci) | 6.0 kG. |

As indicated above, the intrinsic induction value of the powder is about 70 percent of its magnetic remanence, more than two-thirds of its magnetic remanence value.

Throughout this specification and unless specified otherwise, the intrinsic induction, Bd, of a magnetic material always refers to the intrinsic induction measured at two-thirds of its intrinsic coercivity, Hci.

In determining the above-listed magnetic properties, no demagnetization correction factor was used. If the demagnetization factor is used, the values are as follows:

| | |
|---|---|
| Br | 9.16 kG |
| Hci | 9.75 kOe |
| BHmax | 17.3 MGOe |
| Bd | 7.3 kG. |

It is noted that the intrinsic induction of the powder, determined by taking into consideration of the demagnetization correction factor, is about 80 percent of its magnetic remanence.

Example 2

An alloy of the composition as given in Example 1 was melt spun in a helium atmosphere at 20 meters per second. The ribbons obtained from the melt spinning process were crushed into powder and annealed at 630° C. for 4 minutes. The magnetic properties of the powder, without using the demagnetization correction factor, are listed as follows:

| | |
|---|---|
| Br | 8.4 kG |
| Hci | 9.44 kOe |
| Bd | 5.676 kG. |

Again, the intrinsic induction of the powder is more than two-thirds of its magnetic remanence.

Example 3

An alloy of the composition as given in Example 1 was melt spun at 36 meters per second in an inert environment. During this process, the distance between an orifice and a wheel is maintained at one inch. The ribbons formed by this process were crushed into powder and annealed at a temperature of 640° C. for 4 minutes. The magnetic properties of the powder, without considering the demagnetization correction factor, are as follows:

| | |
|---|---|
| Br | 8.48 kG; |
| Hci | 9.87 kOe; |
| BHmax | 14.4 MGOe; and |
| Bd | 6.4 kG. |

The intrinsic induction in this case is more than 75 percent of its magnetic remanence.

As can be seen from the above examples, the intrinsic induction value of the isotropic magnetic powder of the present invention is greater than two-thirds of its remanence value. Preferably, it is more than 70 percent of its remanence and more preferably, more than 75 percent of its remanence. In comparison, conventional isotropic powder of rare earth, boron and iron has an intrinsic induction value of less than two-thirds of its magnetic remanence.

In accordance with the present invention, the melt spinning process may be performed in any inert environment, such as vacuum, argon, helium, etc. Preferably, during the melt spinning process, the nozzle to wheel distance is less than one and one half inches because if such distance is greater than one and one half inches, the magnetic properties of the powder obtained are reduced.

The present invention is not to be limited in scope by the specific embodiments described above which are intended as single illustrations of individual aspects of the invention. Various modifications of the invention, in addition to those shown and described herein, will become apparent to those skilled in the art from the foregoing description and accompanying drawings. Such modifications are intended to fall within the scope of the appended claims.

what is claimed is:

1. Isotropic magnetic material consisting of, by weight percentage, approximately 15 to 35 percent of one or more rare earth metals, approximately 0.5 to 4.5 percent of boron, approximately 0 to 20 percent of cobalt and balanced with iron, said material having an intrinsic magnetic induction, when measured at two third of its intrinsic coercivity and without taking into consideration of demagnetization correction factor, of at least two-thirds of its magnetic remanence.

2. The magnetic material of claim 1 wherein said intrinsic magnetic induction is at least 70 percent of its magnetic remanence.

3. The magnetic material of claim 1 wherein said intrinsic magnetic induction is at least 75 percent of its magnetic remanence.

4. The magnetic material of claim 1 having been made by a process comprising a melt spinning step.

5. The magnetic material of claim 4 wherein said melt spinning step employs an orifice and a wheel, with a distance between said orifice and wheel being less than one and one half inches.

6. The magnetic material of claim 4 wherein said process further comprises a step of, after said melt spinning step, crushing ribbons obtained from said melt spinning step into powder.

7. The magnetic material of claim 6 therein said process further comprises a step of, after said step of crushing ribbons into powder, annealing said powder.

8. The magnetic material of claim 7 wherein said annealing is performed at a temperature of above 600° C.

9. Isotropic magnetic material made from an alloy having a composition consisting of, by weight percentage, approximately 15 to 35 percent of one or more rare earth metals, approximately 0.5 to 4.5 percent of boron, and approximately 0 to 20 percent of cobalt, balanced with iron, said material having an intrinsic magnetic induction, when measured at two-thirds of its intrinsic coercivity and without taking into consideration of demagnetization correction factor, of at least two-thirds of its magnetic remanence, said material having been made by a melt spinning process.

10. The isotropic magnetic material of claim 9 wherein said melt spinning process employs an orifice and a wheel, with a distance between said orifice and wheel being less than one and one half inches.

11. Isotropic magnetic material made from an alloy having a composition consisting of, by weight percentage, approximately 15 to 35 percent of one or more rare earth metals, approximately 0.5 to 4.5 percent of boron, and approximately 0 to 20 percent of cobalt, balanced with iron, said magnetic material having an intrinsic magnetic induction, when measured at two-thirds of its intrinsic coercivity and without taking into consideration of demagnetization correction factor, of at least two-thirds of its magnetic remanence, said magnetic material having been made by a melt spinning process wherein said alloy is melted and spun into ribbons, with a distance between an orifice and a wheel being less than one and one half inches, followed by a process of crushing said ribbons into powder and annealing said powder.

12. The isotropic magnetic material of claimed 11 wherein said ribbons are crushed into powder of less than 40 mesh size.

13. The isotropic magnetic material of claim 11 wherein said annealing is performed at a temperature of at least 600° C.

* * * * *